US006145942A

United States Patent [19]

Borgen

[11] Patent Number: 6,145,942

[45] Date of Patent: Nov. 14, 2000

[54] HOLD-OPEN DOOR CLOSURE ASSEMBLY AND METHOD FOR USING SAME

[75] Inventor: Arden L. Borgen, Des Moines, Iowa

[73] Assignee: Margaret Platt Borgen, Des Moines, Iowa

[21] Appl. No.: 09/118,049

[22] Filed: Jul. 17, 1998

[51] Int. Cl.[7] ..... A47F 3/02

[52] U.S. Cl. ..... 312/138.1; 312/319.2; 312/116; 49/346

[58] Field of Search ..... 312/116, 319.2, 312/326, 329, 138.1; 49/346; 16/DIG. 17

[56] References Cited

U.S. PATENT DOCUMENTS

| | | | |
|---|---|---|---|
| 270,340 | 1/1883 | Rose | 49/346 |
| 777,895 | 12/1904 | Geraci | 312/116 X |
| 1,511,010 | 10/1924 | Spencer, Jr. | 49/346 |
| 1,574,388 | 2/1926 | Hart | 49/346 |
| 3,630,560 | 12/1971 | Atkins et al. | 16/DIG. 17 X |
| 4,818,043 | 4/1989 | Borgen | 312/138.1 |
| 4,940,297 | 7/1990 | Borgen | 312/116 X |
| 5,363,611 | 11/1994 | Richardson et al. | 312/116 |
| 5,392,562 | 2/1995 | Carambula | 49/346 |
| 5,522,656 | 6/1996 | Jenkins | 312/319.2 X |
| 5,882,099 | 3/1999 | Salice | 312/316.2 X |

FOREIGN PATENT DOCUMENTS

| | | | |
|---|---|---|---|
| 1059643 | 3/1954 | France | 312/138.1 |
| 354692 | 7/1961 | Switzerland | 49/346 |

OTHER PUBLICATIONS

Installation instructions for ROYBI® Door Closer dated before Jul. 17, 1997.

*Primary Examiner*—Peter M. Cuomo
*Assistant Examiner*—David E. Allred
*Attorney, Agent, or Firm*—Zarley, McKee, Thomte, Voorhees & Sease

[57] ABSTRACT

A cooled display case includes a plurality of walls enclosing a compartment for displaying merchandise. A door is fitted within a door opening of the cooling compartment and swings from a closed position to a first open position and a second open position. A door closer yieldably urges the door to the closed position whenever the door is in a position other than the second open position. The door closer yieldably holds the door against swinging movement whenever the door is in the second open position. The door closer includes a guide arm which rolls within a guide track mounted on the door, and a track stop is detachably mounted to the track to block movement of the guide member in the track to prevent the door from moving to its second open position. The method involves selectively removing the stop pin so that the door is free to move to its second open position.

9 Claims, 4 Drawing Sheets

HOLD-OPEN DOOR CLOSURE ASSEMBLY AND METHOD FOR USING SAME

BACKGROUND OF THE INVENTION

This invention relates to a hold-open door closure assembly and method for using same, and particularly to a hold-open door closure assembly for cooled display cases.

Cooled display cases often include one or more doors which may be opened for access to the interior of the display case. When the access is being provided to customers, it is sometimes desirable to be able to include automatic door closers on the doors for causing the doors to return to their closed and sealed position after the customer has made a selection from the contents of the display case.

Under other circumstances however, as for example when stocking the case with its contents, it is desirable to maintain the doors in an open position so that the person stocking the case can easily enter and exit the display case.

Door closers have been provided for automatically closing the doors to the cooled display cases. In some instances these door closers have the capability of holding the door open once the door has been opened to a predetermined position. However, if the hold-open feature of the door closer is always operable, there is a problem encountered when customers leave the door open and fail to close it. It is therefore desirable to be able to change the door closer from a hold open mode to a non hold-open mode, so that the non hold-open mode can be used when customers are gaining access to the interior of the display case.

Therefore a primary object of the present invention is the provision of an improved hold-open door closure assembly and method for using same.

A further object of the present invention is the provision of an improved hold-open door closure assembly and method for changing same from a hold-open mode to a non hold-open mode as desired.

A further object of the present invention is the provision of an improved hold-open door closure assembly and method for using same which can readily use door closers that are presently commercially available.

A further object of the present invention is the provision of an improved door closure assembly and method for using same which is economical to manufacture, durable in use, and efficient in operation.

SUMMARY OF THE INVENTION

The foregoing objects may be achieved by a case including a case frame and a plurality of case walls connected to the case frame and forming an enclosed compartment for containing merchandise.

At least one door is fitted within the door opening and is hinged to swing about a door hinge axis from a closed position in a sealed covering relationship over the door opening to a first open position and then to a second open position wherein the door is open wider than in its first open position.

A door closer is connected to both the door and the case frame and yieldably urges the door to its closed position whenever the door is in a position other than its second open position. The door closer yieldably holds the door against swinging movement whenever the door is in the second open position.

The door includes a track and the door closer includes a guide member movably mounted in the track for movement therein during movement of the door from its closed to its first and second open positions. A track stop is detachably mounted to the track in a predetermined position wherein the track stop blocks movement of the guide member in the track to prevent the door from moving from its first open to its second open position.

The method for using the door closer includes detachably mounting the stop member to the track in a first position whereby the stop member engages and stops the guide member from moving in the track and prevents the door from reaching its hold-open position whenever the door swings from the closed position toward the hold-open position.

An additional optional step to the method of the present invention is to detach and remove the stop member from the track so as to permit the door to move from its closed position to its hold-open position.

DETAILED DESCRIPTION OF THE PREFERRED EMBODIMENT

Figure 1:
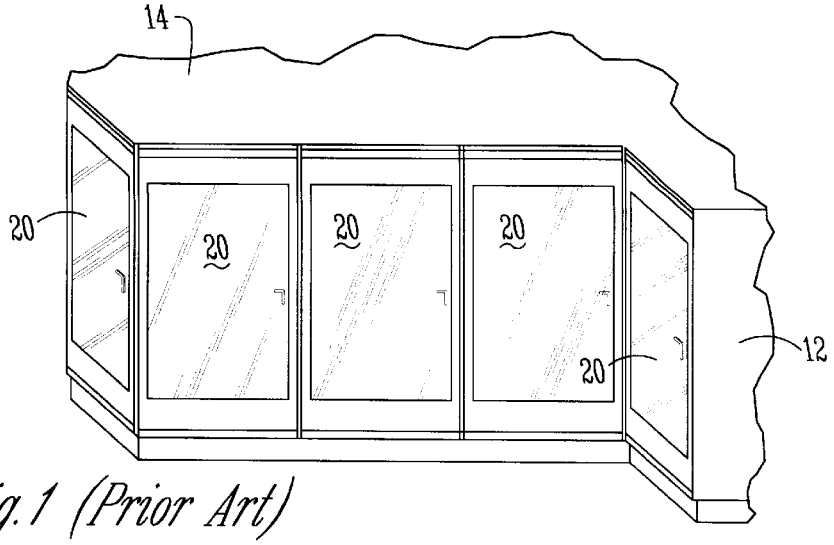
Fig. 1 (Prior Art)
FIG. 1 is a perspective view of a typical cooling case utilizing the present invention.
Figure 2:
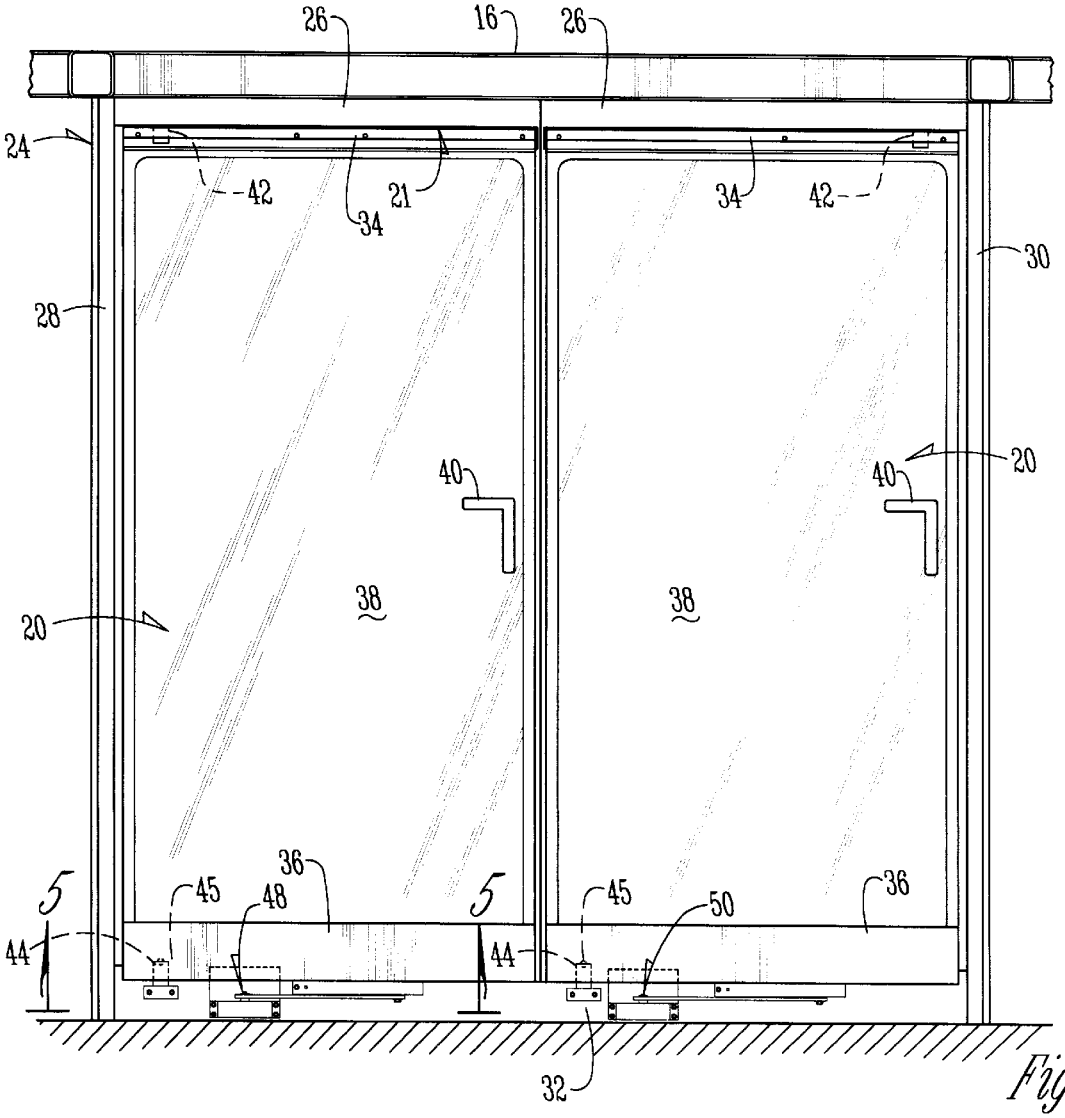
FIG. 2 is a partial front elevational view of FIG. 1 showing the doors to the cooled display case.

Referring to FIG. 1, a cooling display case 10 includes side walls 12, a top wall 14, and a plurality of frameless glass door 20 which together form a compartment therein. The display compartment may be cooled, uncooled, or heated.

Doors 20 are mounted in edge to edge relation, and are of similar construction to the doors shown in U.S. Pat. No. 4,818,043. Above and below each door 20 respectively are a header 26, and a threshold frame member 32.

Each of the doors 20 include a horizontal top frame member 34 and a horizontal bottom frame member 36 which are fitted over rectangular door glass panel assembly 38. The glass panel 38 may be a single pane, a double pane, or perhaps even a triple pane, depending upon the desired R-value needed for the door. Each door 20 is provided with a handle 40 for permitting the doors to be opened and closed.

Figure 3:
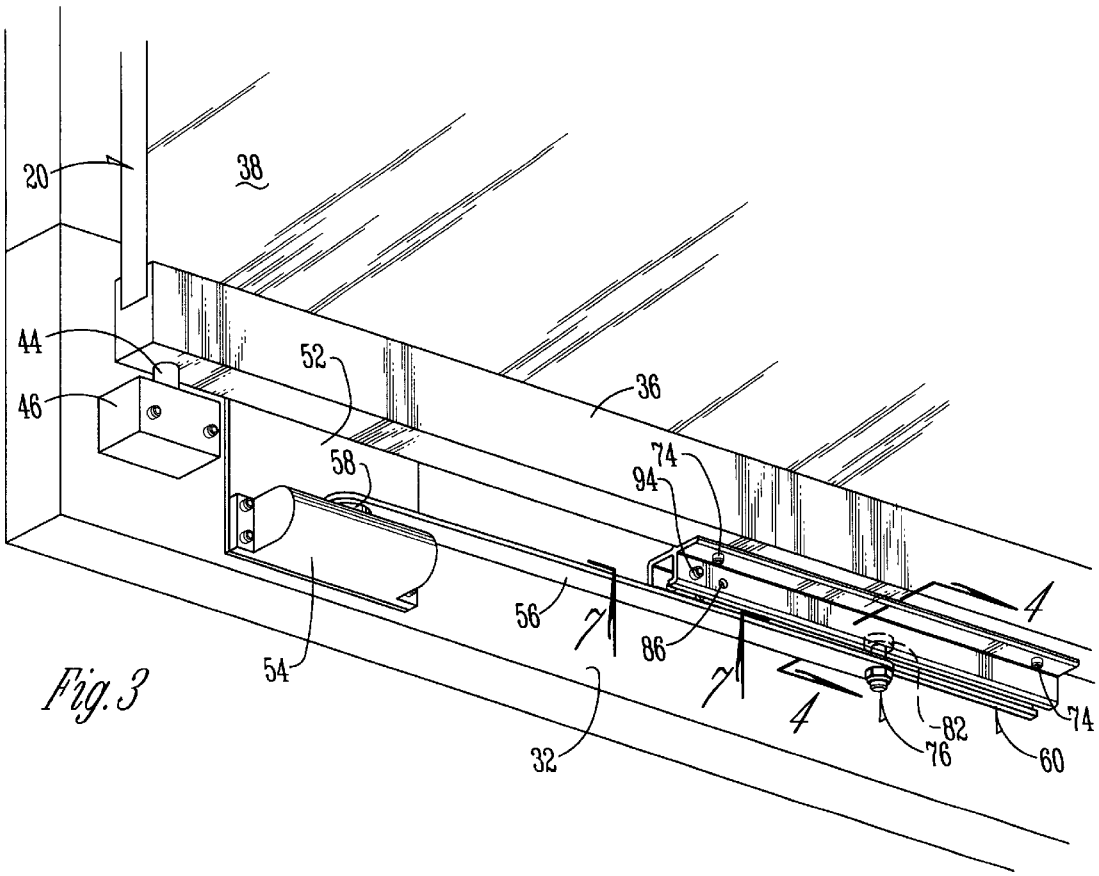
FIG. 3 is a partial bottom perspective view showing the door closer of the present invention.

The doors 20 are mounted for hinged movement about a vertical axis by means of an upper hinge pin 42 and a lower hinge pin 44. The lower hinge pin 44 may be provided with a bearing 45 to facilitate pivotal movement. The lower hinge pin 44 is attached to a hinge pin support block 46 (FIG. 3) which is bolted or otherwise secured to the threshold frame 32.

Door 20 is attached to a first door closer 48, and door 22 is attached to a second door closer 50, both of which are of identical construction.

Numerous door closers are on the market which have "hold-open" features permitting them to hold a door open once a door has reached a certain predetermined position. The particular door closer shown in the drawing is the preferred embodiment, and is a commercially available door closer manufactured by Ryobi America Corporation, 1424 Pearman Dairy Road, Anderson, S.C. 29625 under the model number SC85D. This door closer has a built in non adjustable hold-open feature. By opening the door beyond a predetermined angle the door will remain open. To close, the door is simply pulled or pushed back to the predetermined angle and released. The door closer will then automatically urge the door to its closed position.

Referring to FIGS. 3–6, a mounting plate 52 is bolted or otherwise secured to the threshold frame member 32. The door closer housing 54 is mounted to the mounting plate 52 and includes a closer arm 56 which is pivotally connected to the closer housing 54 for pivotal movement around a closer arm pivot 58.

Mounted to the bottom edge of the door bottom frame member 36 is a guide channel 60 which is in the form of an extrusion and which includes a guide track 62 (FIG. 4) formed by side rails 64, 66 and web 70. Side rails 64, 66 are each provided with inwardly protruding lips 68. Extending from the guide channel 60 is a mounting flange 72 which is mounted to the under edge of the door bottom frame member 36 by means of bolts 74.

Mounted on the outer end of closer arm 56 is a roller shaft 76 which extends through the closer arm 56 and which includes a bushing 78 and a guide roller 82 positioned between the closer arm 56 and a shaft head 80. A nut 84 holds the roller shaft to the closer arm 56, and the guide roller 82 is adapted to roll and move longitudinally within the guide track 62.

Figure 7:
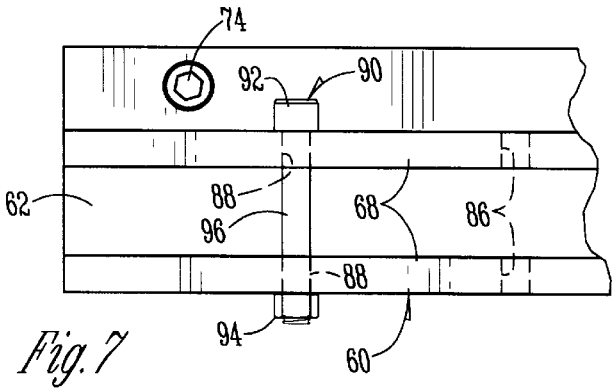
FIG. 7 is partial bottom view of the guide track taken along lines 7—7 of FIG. 3.
Figure 4:
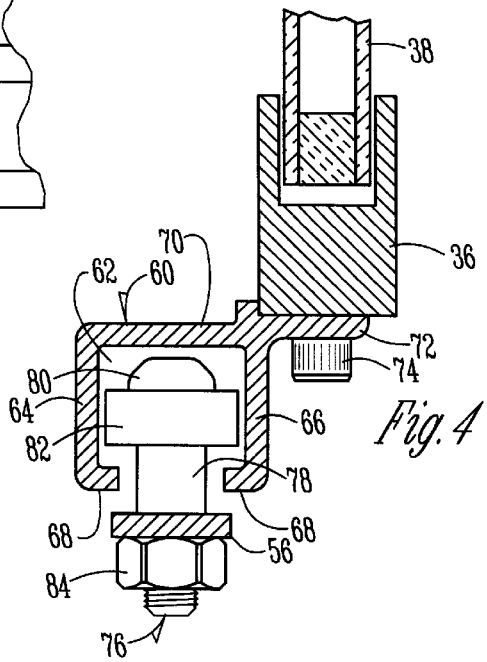
FIG. 4 is a sectional view taken along line 4—4 of FIG. 3.

Adjacent one end of guide channel 60 are a first pair of registered holes 86 and a second pair of registered holes 88 which are spaced longitudinally apart from one another. A stop pin 90 is detachably retained in one or the other of the pairs of holes 86, 88 and includes a head 92, a removable nut 94, and a shaft 96 which extends across the guide track 62 as can be readily seen in FIG. 7.

The stop pin 90 is removable from either of the pairs of holes 86, 88, and can be placed alternatively in each of those two pairs of holes.

Figure 5:
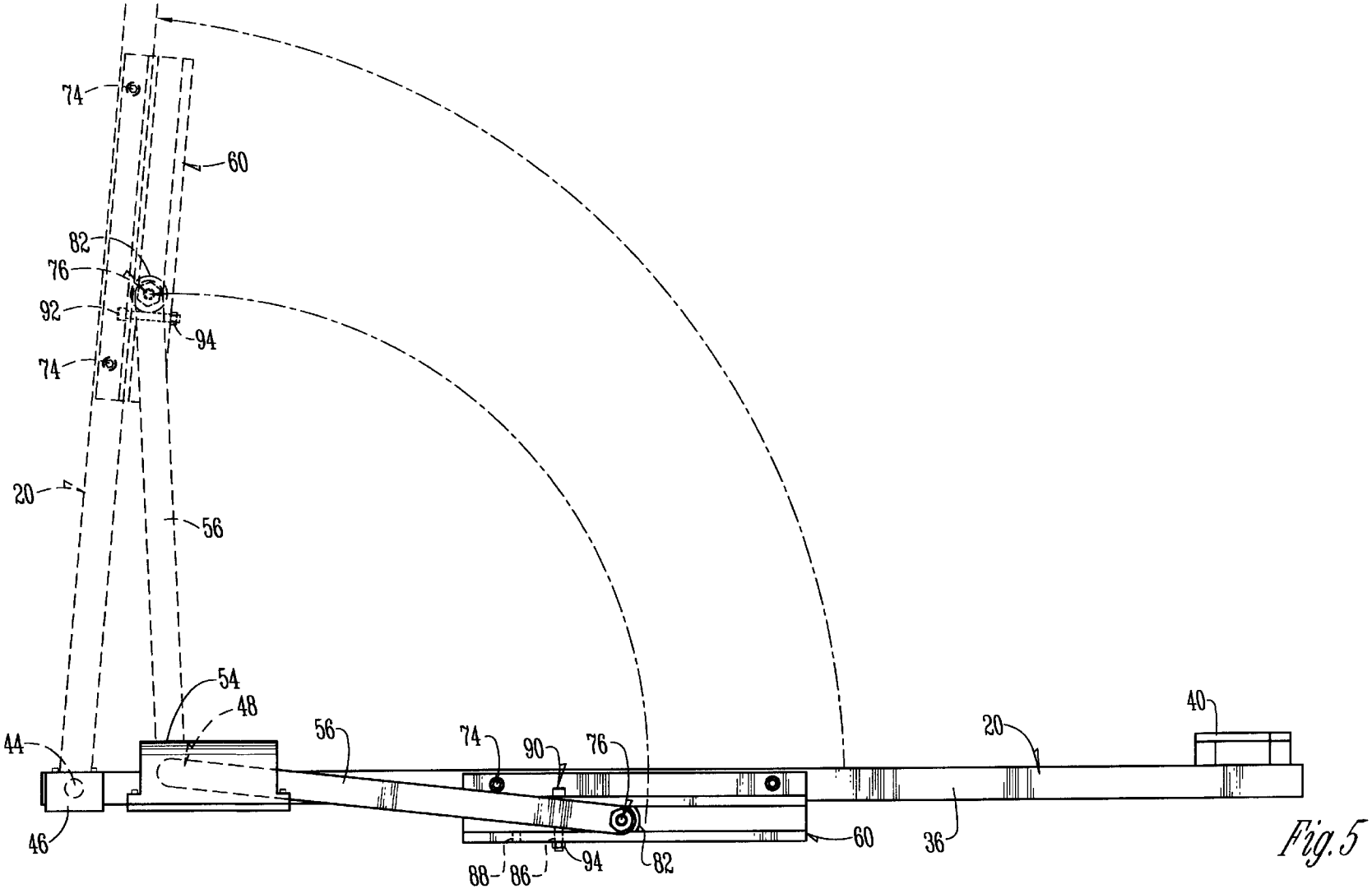
FIG. 5 is a bottom plan view taken along line 5—5 of FIG. 2, and showing the door closer in its non-hold-open mode.

Referring to FIG. 5 the stop pin 90 is shown placed in the registered pair of holes 88 so as to prevent the door closer from moving to its hold-open position. This is illustrated in FIG. 5 in the shadow lines which illustrate that the guide roller 82 encounters pin 90 when the door 20 is moved from its closed position to a first-open position slightly less than 85° from its closed position. At this point the door closer 48 has not been moved to its hold-open position, and therefore it yieldably urges the door 20 to return to its closed position. Thus the door is in a "no hold-open" mode for use by customers who desire to reach into the cooling display case 10 to retrieve merchandise from the interior of the cooling display case 10.

Figure 6:
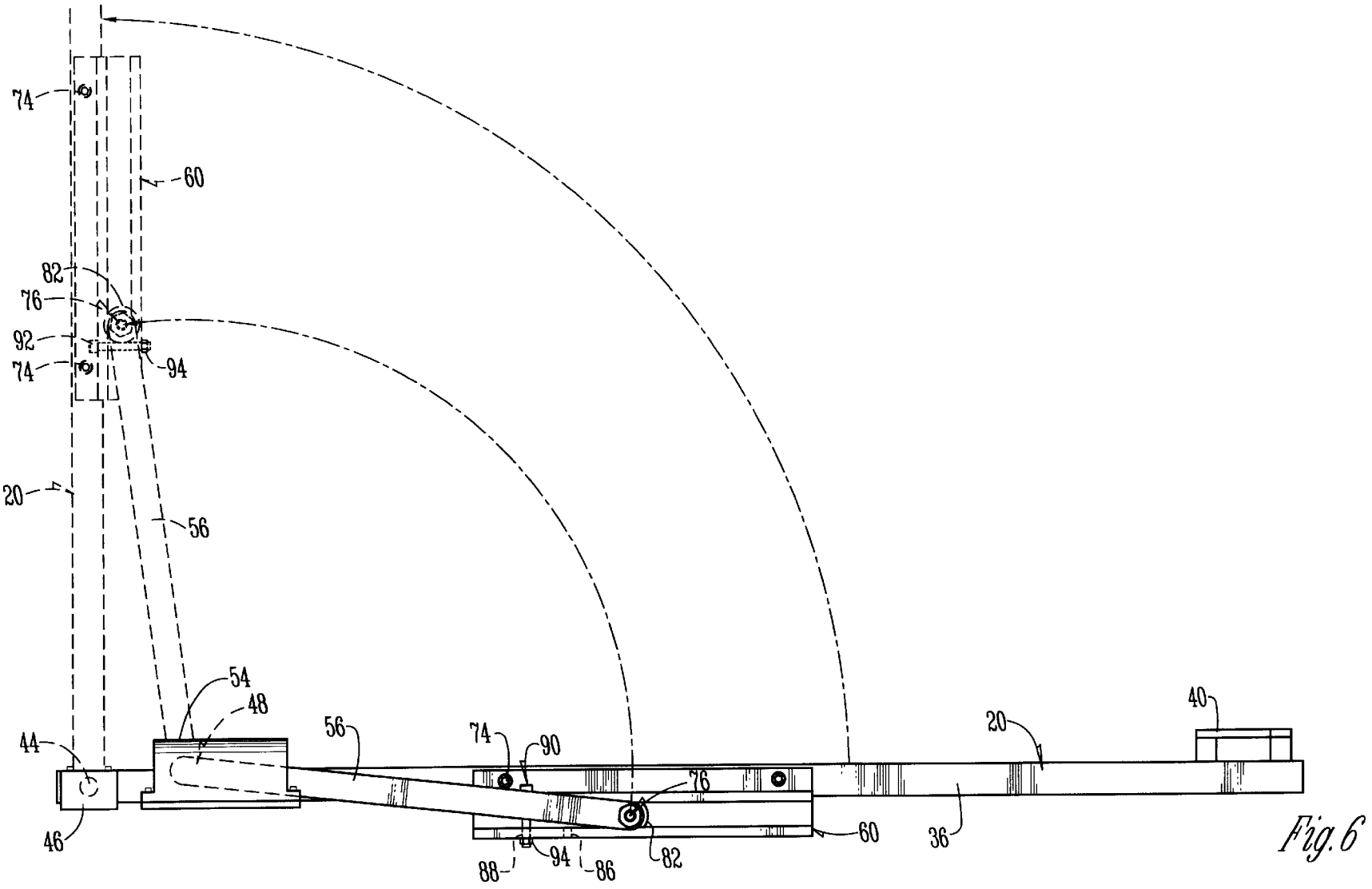
FIG. 6 is a view similar to FIG. 5, but showing the door closer in its hold-open mode.

However, when it is desired to keep the door in an open position as might be the case when stocking the contents of cooling display case 10, the operator can remove the pin 90 from the first pair of holes 86 and move the pin 90 to the second pair of holes 88 as shown in FIG. 6. This permits the door to move to a second open position which is slightly wider than 85°. The door closer 48 responds to this movement by automatically implementing its hold-open feature which permits the door to yieldably remain in an open position. The operator can then stock the contents of the display case 10, and when the stocking is completed the door may be moved to approximately the 85° position and released and it will automatically return to its closed position.

The door closer 48, as explained above, is a commercially available door closer. However, the particular model SC85D manufactured by Ryobi America Corporation has been modified for the present invention. The commercially available door closer includes a link having one end pivotally connected where the guide roller 76 is shown in the drawings and having the other end pivotally mounted to a bracket on the door. The link and the bracket have been removed for the purposes of the present invention, and the arm 56 has been provided with the roller shaft 76, the bushing 78, and the guide roller 82, so that it can roll directly in the guide track 62.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A case comprising:

a case frame;

a plurality of case walls connected to said case frame and forming an enclosed compartment for containing merchandise said case walls forming a door opening;

at least one door fitted within said door opening and being hinged to swing about a door hinge axis from a closed position in sealed covering relation over said door opening to a first open position and to a second open position wherein said door is open wider than in said first open position;

a door closer means connected to both said door and said case frame and yieldably urging said door to said closed position whenever said door is in a position other than said second open position, said door closer means yieldably holding said door against swinging movement whenever said door is in said second open position;

said door having a track mounted thereon;

a guide member connected to said door closer means and being movably mounted in said track for movement therein during movement of said door from said closed to said first and second open positions;

a track stop separate from said guide member and detachably mounted to said track in a predetermined position wherein said track stop permits movement of said guide member within said track during movement of said door between said closed and said first open positions and blocks movement of said guide member in said track to prevent said door from moving from said first open to said second open position.

2. A case according to claim 1 wherein said track stop is detachable and removable from said track so as to permit said guide member to move within said track during movement of said door from said first open position to said second open position.

3. A case according to claim 1 wherein said track stop comprises an elongated member, and said track includes a first receptacle for detachably receiving said track stop and retaining said track stop in said predetermined position.

4. A case according to claim 3 wherein said track includes a second receptacle for detachably receiving said track stop, said second receptacle being positioned in said track to cause said stop member to limit movement of said door beyond said second open position whenever said track stop is in said second receptacle.

5. A case according to claim 4 wherein said track includes two spaced apart track members forming a guide way therebetween for receiving said guide member, said first and second receptacles each comprising a pair of aligned holes in said two spaced apart track members respectively for receiving said elongated stop member in a position extending across said guide way.

6. A case according to claim 1 wherein said door closer means further comprises an elongated arm member pivotal about a guide axis, said guide member being carried on said arm member.

7. A case comprising:

a case frame;

a plurality of case walls connected to said case frame and forming an enclosed compartment for containing merchandise, said case walls forming a door opening therein;

at least one door fitted within said door opening and being hinged to swing about a door hinge axis from a closed position in sealed covering relation over said door opening to a first open position and to a second open position wherein said door is open wider than in said first position;

a track carried by said door as said door moves from said closed position to said first and second open positions;

a guide member retained in said track and being movable therein;

a closer arm connected to said guide member;

a door closer means fixed to said case frame and connected to said closer arm for moving said closer arm to urge said door to said closed position when said door is in said first open position and for causing said closer arm to hold said door against closing whenever said door is moved to said open position;

a track stop separate from said guide member and being detachably mounted in said track in a no hold open position wherein said track stop engages said guide member and prevents said door from moving from its said first open position to its said second open position;

said track stop being detachable from said track to permit said door to move freely from its closed position to both of said first and second open positions.

8. A case according to claim 7 wherein said closer arm is pivotally mounted to said door closer means for pivotal movement about a closer axis.

9. A case according to claim 7 wherein said track stop comprises an elongated member, said track having openings therein for receiving said elongated member in a position which extends transversely of said track to block movement of said guide member in said track.

* * * * *